US007127070B2

(12) United States Patent
Kimura et al.

(10) Patent No.: US 7,127,070 B2
(45) Date of Patent: Oct. 24, 2006

(54) LOUDSPEAKER BROADCASTING SYSTEM AND LOUDSPEAKER BROADCASTING APPARATUS

(75) Inventors: Tsuyoshi Kimura, Tokyo (JP); Atsunao Shinoda, Tokyo (JP); Kuniaki Ohsawa, Kanagawa (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 188 days.

(21) Appl. No.: 10/331,867

(22) Filed: Dec. 30, 2002

(65) Prior Publication Data

US 2003/0128850 A1 Jul. 10, 2003

(30) Foreign Application Priority Data

Jan. 4, 2002 (JP) ..... P.2002-000122

(51) Int. Cl.
*H04R 29/00* (2006.01)

(52) U.S. Cl. ..... 381/56; 340/692; 340/577; 340/628

(58) Field of Classification Search ..... 381/56, 381/58, 57, 66, 103, 83, 93; 340/524, 628, 340/539, 577, 692
See application file for complete search history.

(56) References Cited

U.S. PATENT DOCUMENTS 3,873,779 A * 3/1975 Wedan ..... 381/18
4,196,314 A * 4/1980 Guillory ..... 381/18
4,288,789 A * 9/1981 Molinick et al. ..... 340/524
4,531,114 A * 7/1985 Topol et al. ..... 340/539.1
4,754,266 A * 6/1988 Shand et al. ..... 340/691.2
5,073,945 A * 12/1991 Kageyama et al. ..... 381/89
5,666,426 A * 9/1997 Helms ..... 381/57
6,252,969 B1 * 6/2001 Ando ..... 381/103
6,600,424 B1 * 7/2003 Morris ..... 340/628
6,646,545 B1 * 11/2003 Bligh ..... 340/286.05

FOREIGN PATENT DOCUMENTS

JP 60-130999 7/1985
JP 10188156 A 7/1998
JP 2000194977 A 7/2000

* cited by examiner

*Primary Examiner*—Brian T. Pendleton
(74) *Attorney, Agent, or Firm*—Pearne & Gordon LLP

(57) ABSTRACT

To provide a loudspeaker broadcasting system and a loudspeaker broadcasting apparatus which can perform a loudspeaker broadcasting of appropriate contents at each block without reducing sound clearness. Bi-directional speakers 1 which performs sound-reinforcement having high intelligibility, and fire detecting sensors 3 which detect fire occurrence in a tunnel 10*a*, 10*b* and send fire occurrence signals are placed in the tunnel 10*a*, 10*b* in the tunnel extending direction. In an emergency such as a fire, emergency broadcasting is performed through each bi-directional speaker 1 at each of the predetermined blocks 5 in the tunnel 10*a*, 10*b*. The emergency broadcasting is different in contents at each block, and it is alternately performed at the adjacent blocks 5. Further, the frequency components having a long reverberation time is removed from the loudspeaker broadcasting through the bi-directional speaker 1.

9 Claims, 4 Drawing Sheets

LOUDSPEAKER BROADCASTING SYSTEM AND LOUDSPEAKER BROADCASTING APPARATUS

BACKGROUND OF THE INVENTION

1. Field of the Invention

The present invention relates to a loudspeaker broadcasting system and a loudspeaker broadcasting apparatus which can precisely transmit, in a closed space such as a tunnel or an underpass where sound is difficult to damp and a reverberation time is long, broadcasting contents such as guide of shelter broadcasted in its space in an emergency.

2. Description of the Related Art

Heretofore, in a tunnel and underpass (hereinafter referred to as a [tunnel] simply) and in an institution for managing them, there have been provided a loudspeaker broadcasting system and a loudspeaker broadcasting apparatus for performing emergency broadcasting of shelter guide when a disaster occurs. In an emergency, using speakers placed in emergency parking zones provided at regular intervals (at intervals of about 500 m) , an emergency broadcasting is given to only persons in the emergency parking zones. However, since sound is difficult to damp in the tunnel, a reverberation time becomes long, so that clear sound-reinforcement cannot be obtained. Namely, in case that the speakers are dispersively placed in the tunnel, due to such acoustic characteristic in tunnel that the amplified sound is difficult to damp for a long time, an interference phenomenon of sound occurs among the speakers placed dispersively in the conventional loudspeaker broadcasting system and loudspeaker broadcasting apparatus, and clear sound-reinforcement cannot be performed. Therefore, in JP-A-No. 130999/1985, delay of transmission sound among the speakers placed in the tunnel is corrected by a delay unit thereby to suppress reduction of sound clearness.

However, in the conventional loudspeaker broadcasting system and loudspeaker broadcasting apparatus, only shelter information of the same contents is provided in the tunnel, and it is difficult to perform broadcasting of the different contents according to the condition at each block in the tunnel. The broadcasting of the different contents is, for example, broadcasting for guiding persons, in blocks before a spot where a disaster occurs, to a front emergency exit or a front pithead and guiding persons, in blocks behind the spot, to a back emergency exit or a back pithead.

SUMMARY OF THE INVENTION

The invention has been made in view of the above-mentioned problem and circumstances, and its object is to provide a loudspeaker broadcasting system and a loudspeaker broadcasting apparatus which can perform a loudspeaker broadcasting of appropriate contents at each block without reducing sound clearness.

In order to solve the above problem, a loudspeaker broadcasting system of the invention is a system which performs loudspeaker broadcasting in a closed space. The system comprises a speaker placed at each block of the space, a spot detecting unit detecting a spot in the space, and a control unit that determines, on the basis of the spot detected by the spot-detecting unit, loudspeaker broadcasting contents through the speaker for each block. Therefore, at each block in the space, the loudspeaker broadcasting of the appropriate contents according to the circumstances can be performed.

Further, in the loudspeaker broadcasting system according to the invention, the speaker has bi-directivity in which two speakers having negative-phase outputs face in the opposite directions, or the speaker has bi-directivity in simple. In the speaker, it is possible to reduce reverberation due to reflection sound from sidewalls of the space. Further, by each output of two speakers, sound-reinforcement having high intelligibility can be performed in front and at the back of the space.

Further, the loudspeaker broadcasting system according to the invention is provided with a broadcasting control unit which controls loudspeaker broadcasting through the speakers so as to perform it at the adjacent blocks alternately. Therefore, it is possible to prevent interference of the loudspeaker broadcastings at the adjacent blocks or overlap of sound, so that the loudspeaker broadcasting having the high intelligibility can be performed.

Further, in the loudspeaker broadcasting system according to the invention, the broadcasting control unit provides a sound no-reinforcement time between a loudspeaker broadcasting time and a next loudspeaker broadcasting time to control loudspeaker broadcasting. Therefore, persons in the space can listen to the loudspeaker broadcasting without receiving the influence of reverberation.

Further, the loudspeaker broadcasting system according to the invention is provided with an equalizer which removes frequency components having a long reverberation time when the speaker broadcasting is performed in the space. Therefore, even in the space where the sound is difficult to damp and the reverberation time is long, the sound reinforcement having little reverberation and the high intelligibility can be realized.

Further, the loudspeaker broadcasting system according to the invention is provided with a noise condition detecting unit for detecting a noise condition at one block in the space, which is placed at each block in the space, and a sound volume adjusting unit adjusts, according to a detection result of the noise condition detecting unit, output level of the speaker placed at the same block as the block at which the noise condition detecting unit is placed. Therefore, according to the noise condition at each block, the speaker broadcasting can be provided in a range corresponding to one block.

Further, in the loudspeaker broadcasting system of the invention, the spot detecting unit comprises an accident occurrence detecting sensor that detects occurrence of an accident at one block in the space and outputs an accident occurrence signal including identification data of each sensor, and is placed at each block in the space, and an accident occurrence block detecting unit detects, upon reception of the accident occurrence signal output from the accident occurrence detecting sensor, which block the accident has occurred at on the basis of the identification data included in the accident occurrence signals.

Further, the loudspeaker broadcasting system according to the invention is provided with a sound source storing plural kinds of loudspeakers broadcasting contents through the speaker, and the control unit selects the loudspeaker broadcasting contents through the speaker from the sound source to read out it.

Further, in the loudspeaker broadcasting system according to the invention, the space is a tunnel or an underpass.

Further, a loudspeaker broadcasting apparatus of the invention has the control unit provided for the loudspeaker broadcasting system according to any one of claims 1 to 8.

DESCRIPTIONS OF THE PREFERRED EMBODIMENTS

An embodiment of the loudspeaker broadcasting system and loudspeaker broadcasting apparatus according to the invention will be described below with reference to drawings in detail.

Figure 1:
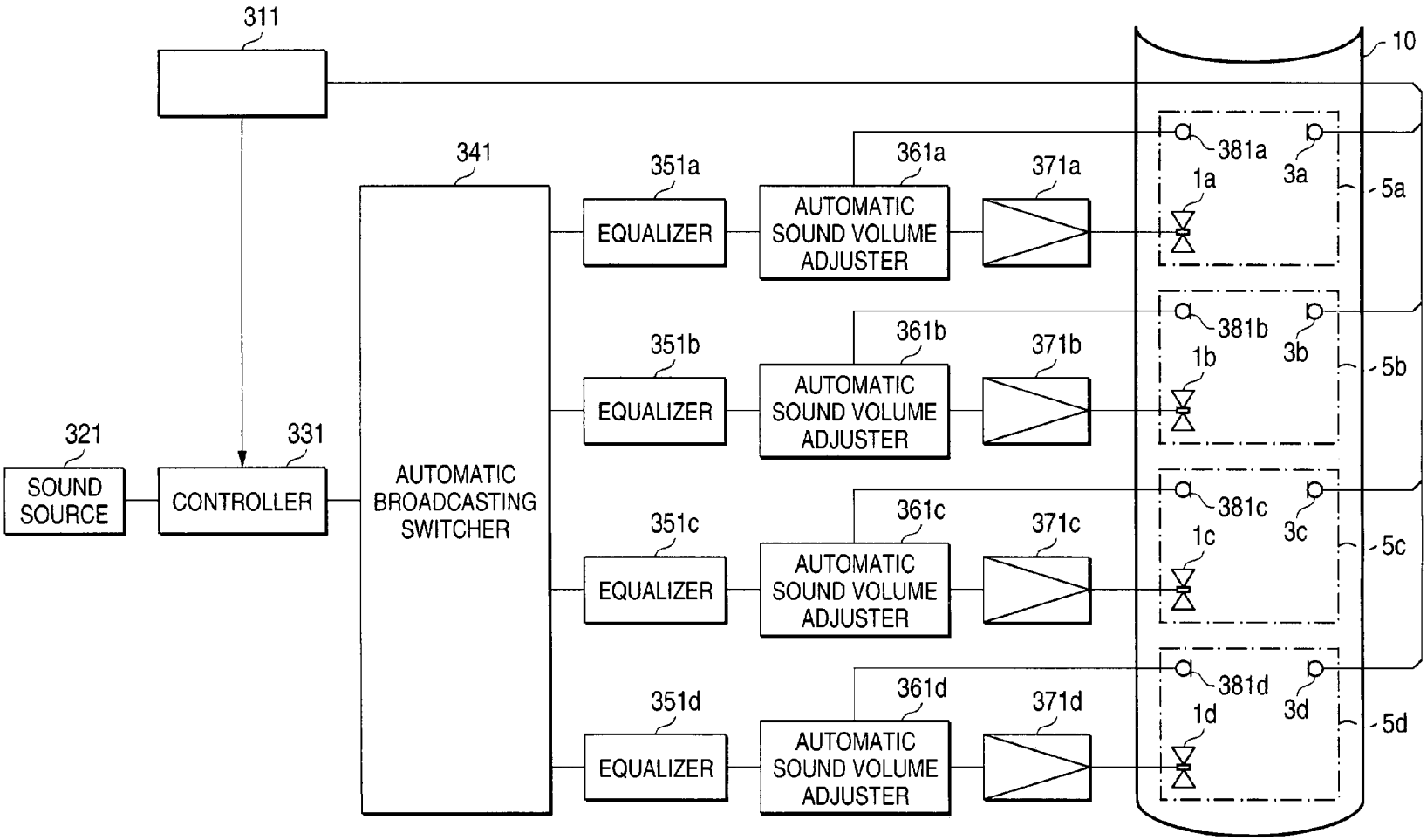
FIG. 1 is a constitutional diagram showing the whole constitution of a loudspeaker broadcasting system according to one embodiment of the invention.

FIG. 1 is a constitutional diagram showing the whole constitution of a loudspeaker broadcasting system according to one embodiment of the invention. As shown in the figure, the loudspeaker broadcasting system according to the one embodiment comprises a bi-directional speaker 1 corresponding to the speaker in the scope of the patent claim, a fire detecting sensor 3 corresponding to the accident occurrence detecting sensor, a fire detector 311 corresponding to the accident occurrence block detecting unit, a sound source 321, a controller 331 corresponding to the control unit, an automatic broadcasting switcher 341 corresponding to the broadcasting control unit, an equalizer 351, an automatic sound volume adjusting sensor 381 corresponding to the noise condition detecting unit, an automatic sound volume adjuster 361 corresponding to the sound volume adjusting unit, and an amplifier 371. The bi-directional speaker 1, the fire detecting sensor 3 and the automatic sound volume adjusting sensor 381 are provided in a closed space such as a tunnel or an underpass where sound is difficult to damp and the reverberation time is long (hereinafter as an example of the closed space, a tunnel 10 is given.).

In FIG. 1, a case where four bi-directional speakers 1*a* to 1*d*, fire detecting sensors 3*a* to 3*d*, equalizers 351*a* to 351*d*, automatic sound volume adjusters 361*a* to 361*d*, amplifiers 371*a* to 371*d*, and automatic sound volume adjusting sensor 381*a* to 381*d* are provided is exemplarily shown. However, these components are not limited to four sets. Further, in the tunnel 10, a block 5 corresponding to each bi-directional speaker 1 is set. In FIG. 1, four blocks 5*a* to 5*d* are set corresponding to the four bi-directional speakers 1*a* to 1*d*.

Each of components which the loudspeaker broadcasting system of this embodiment includes will be described below.

Figure 2:
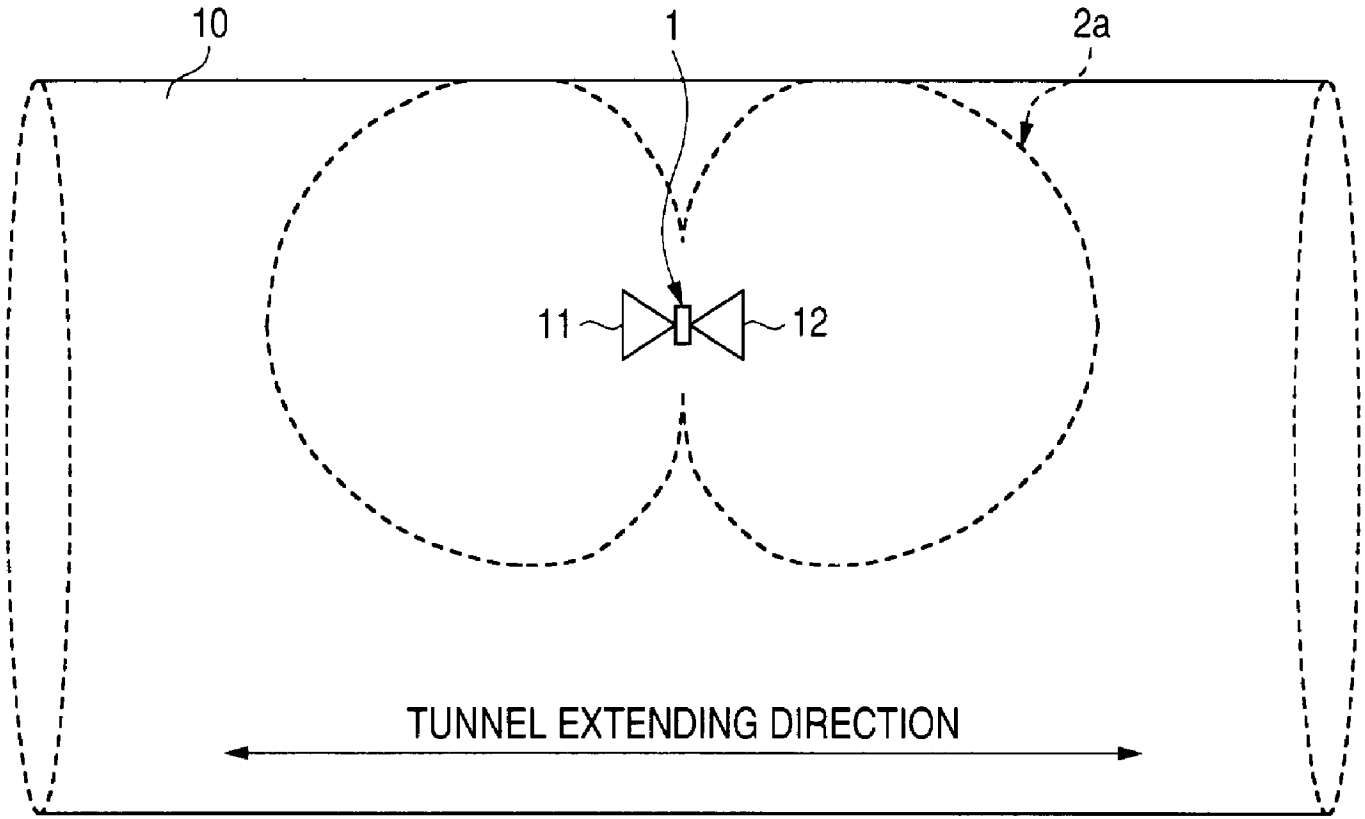
FIG. 2 is a constitutional diagram showing the constitution of a bi-directional speaker provided for the loudspeaker broadcasting system according to the embodiment of the invention.

Firstly, the bi-directional speaker 1 is a speaker for reinforcing sound in the tunnel 10, and its constitution is shown in FIG. 2. FIG. 2 is a constitutional diagram showing the constitution of the bi-directional speaker provided for the loudspeaker broadcasting system according to one embodiment. As shown in the figure, the bi-directional speaker 1 can use the existing speaker and comprises two speakers 11, 12 having negative-phase outputs and facing in the opposite directions. And, the speakers 1 are installed in the vicinity of an inner wall surface of the tunnel 10 in the tunnel extending direction.

As acoustic characteristic of the bi-directional speaker 1, directional characteristic shown by a reference numeral 2*a* in FIG. 2 is obtained. Therefore, reflective sound from the inner wall surface of the tunnel 10 can be reduced. Further, since each output of the two speakers 11, 12 does not have sharp directivity, the loudspeaker broadcastings output from the bi-directional speakers 1 installed at the adjacent blocks do not interfere with each other, but the loudspeaker broadcasting having high intelligibility can be performed in front and at the back of the tunnel 10. Further, since the bi-directional speaker 1 makes possible the sound reinforcement having the high intelligibility in the loudspeaker broadcasting system of this embodiment, it outputs sound from which frequency components having a long reverberation time is removed by the equalizer which will be described later.

Further, the fire-detecting sensor 3 detects occurrence of a fire in the tunnel 10, and outputs a fire occurrence signal including identification data of the fire-detecting sensor 3. Further, the fire detector 311 receives collectively the fire occurrence signals output from the fire detecting sensors 3, and when it receives the fire occurrence signal from any one of the fire detecting sensors 3, it sends the identification data of the fire detecting sensor included in the fire occurrence signal together with a trigger signal for driving the controller 331 to the controller 331.

Further, the sound source 321 is storing the loudspeaker broadcasting contents by the bi-directional speaker 1, and the plural kinds of broadcasting contents. Further, the controller 331 automatically operates by the trigger signal from the fire detector 311, and detects which block in the tunnel 10 a fire occurs at on the basis of the identification data of the fire-detecting sensor sent from the fire detector 311. Further, the controller 331 selects the broadcasting contents appropriate to each block 5 to reads out it from the sound source 321, and instructs the automatic broadcasting switcher 341 to broadcast the selected broadcasting contents at the predetermined time band at each block.

Figure 3:
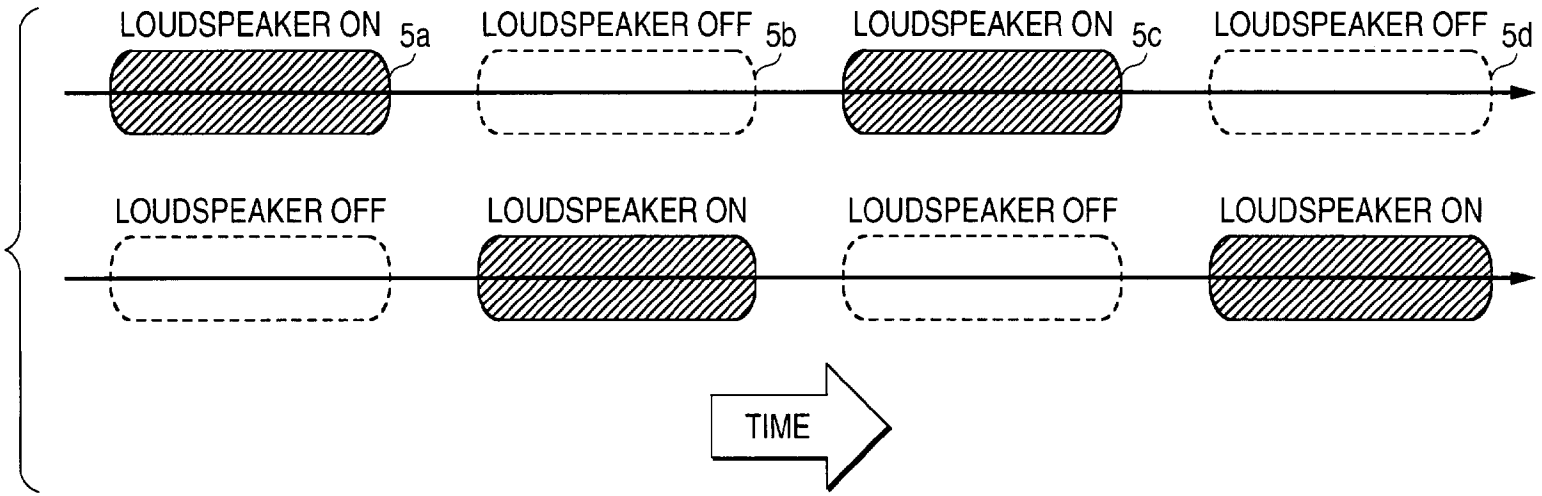
FIG. 3 is an explanatory view showing a broadcasting timing at each block of the loudspeaker broadcasting system according to the embodiment of the invention.

Further, the automatic broadcasting switcher 341 switches at each predetermined time the block 5 at which the loudspeaker broadcasting is performed in accordance with the instruction from the controller 331. In this embodiment, as shown in FIG. 3, the loudspeaker broadcasting is not simultaneously performed at the adjacent blocks, but is performed alternately at the adjacent blocks. Namely, at a time band, the loudspeaker broadcasting is performed at the blocks 5*a* and 5*c* (loudspeaker broadcasting ON) but is not performed at the blocks 5*b* and 5*d* (loudspeaker broadcasting OFF). After the predetermined time, at another time band, the loudspeaker broadcasting is performed at the blocks 5*b* and 5*d* (loudspeaker broadcasting ON) but is not performed at the blocks 5*a* and 5*c* (loudspeaker broadcasting OFF). Therefore, it is possible to prevent reduction of sound clearness caused by interference of the loudspeaker broadcastings at the adjacent blocks. Namely, it is possible to prevent reduction of sound clearness caused by overlap of contents of the broadcastings at the adjacent blocks.

Further, in this embodiment, a blank (a sound no-reinforcement time) for several seconds is provided between a loudspeaker broadcasting time and a next loudspeaker broadcasting time. Time of a broadcasted sentences or paragraph is divided, and a blank, for example, for about 5 seconds is provided, whereby even in the broadcasting in the tunnel where the reverberation time is long, it is possible to prevent reduction of the sound clearness caused by the interference between the reverberation sound and the reinforcement sound. Further, the loudspeaker broadcasting is not performed alternately at the adjacent blocks but only the blank may be provided.

Further, the equalizer 351 adjusts sound quality of the loudspeaker broadcasting, and removes frequency components having a long reverberation time. By removing its frequency components by the equalizer 351, it is possible to make a level of the reverberation sound in the tunnel 10 small. Further, the equalizer 351 may not only remove the frequency components but also adjust the level for each frequency component so as to adjust the sound quality of the reinforcement sound output from the bi-directional speaker 1.

Further, the automatic sound volume-adjusting sensor 381 detects noise condition (sound pressure level, kind of sound, and so on) at each block in the tunnel 10. Its detection result (hereinafter referred to as ⌈noise condition detecting result⌋) is sent to the corresponding automatic sound volume adjuster 361. Further, the automatic volume adjuster 361, on the basis of the noise condition detecting result sent from the automatic sound volume-adjusting sensor 381, adjusts the output level of the bi-directional speaker 1. Further, the amplifier 371 amplifies the sound input through the equalizer 351 and the automatic sound volume adjuster 361.

Figure 4:
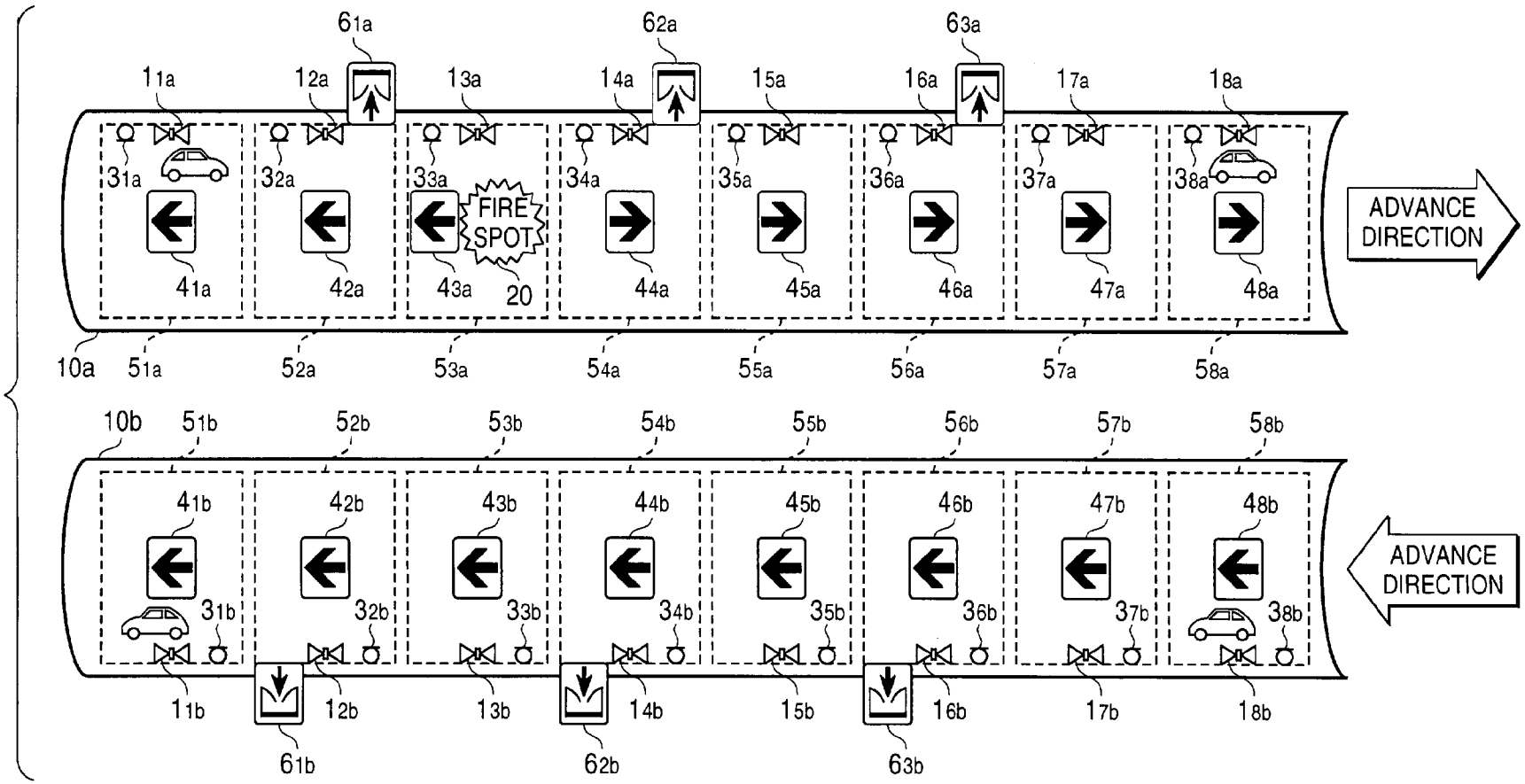
FIG. 4 is an explanatory view showing the state in a tunnel where the loudspeaker broadcasting system according to the embodiment of the invention is installed.

With reference to FIG. 4, the operation of this system when a fire occurs in the tunnel 10 where the loudspeaker broadcasting system of this embodiment is installed will be described below. FIG. 4 is an explanatory diagram showing the condition of the inside of the tunnel in which the loudspeaker broadcasting system of this embodiment is installed. In the figure, a two-lane road runs in the tunnel, and the respective lanes will be referred to as a tunnel 10*a* and a tunnel 10*b* below. Further, reference numerals $\mathbf{1}_{1a}$ to $\mathbf{1}_{8a}$ and $\mathbf{1}_{1b}$ to $\mathbf{1}_{8b}$ are the bi-directional speakers 1, reference numerals $\mathbf{3}_{1a}$ to $\mathbf{3}_{8a}$ and $\mathbf{3}_{1b}$ to $\mathbf{3}_{8b}$ are the fire detecting sensors 3, and reference numerals $\mathbf{5}_{1a}$ to $\mathbf{5}_{8a}$ and $\mathbf{5}_{1b}$ to $\mathbf{5}_{8b}$ are the blocks at which the loudspeaker broadcasting is performed by each bi-directional speaker 1 in the tunnel 10.

Further, reference numerals $\mathbf{6}_{1a}$ to $\mathbf{6}_{3a}$ represent emergency exits provided in the tunnel 10*a*, and reference numerals $\mathbf{6}_{1b}$ to $\mathbf{6}_{3b}$ represent emergency exits provided in the tunnel 10*b*. Further, reference numeral 20 represents a spot at which an accident such as a fire occurs (hereinafter referred to as a ⌈accident occurrence spot⌋) . Further, arrows of reference numerals $\mathbf{4}_{1a}$ to $\mathbf{4}_{8a}$, and $\mathbf{4}_{1b}$ to $\mathbf{4}_{8b}$ represent the broadcasting contents for guide of shelter by the loudspeaker broadcasting system in this embodiment for convenience, and the direction of the arrow represents a shelter direction.

In case that a fire occurs at the block $\mathbf{5}_{3a}$ in the tunnel 10*a*, the fire detecting sensor $\mathbf{3}_{3a}$ detects this fire and sends the fire occurrence signal to the fire detector 311. The fire detector 311, upon reception of the fire occurrence signal, sends a trigger signal and a signal indicating that the fire occurrence signal has been sent from the fire detecting sensor $\mathbf{3}_{3a}$ to the controller 331. The controller 331 reads from the sound source 321 sound contents such as ⌈A fire occurs in front.⌋ or ⌈Please shelter in the opposite direction to the advance direction⌋, and cooperates with the automatic broadcasting switcher 341, whereby the loudspeaker broadcasting of the optimum contents is performed from the bi-directional speaker 1 placed at each block.

In the example shown in FIG. 4, since the accident occurrence spot 20 belongs to the block $\mathbf{5}_{3a}$, the loudspeaker broadcasting that instructs persons to shelter in the opposite direction to the advance direction at the blocks $\mathbf{5}_{1a}$ to $\mathbf{5}_{3a}$ in the tunnel 10*a*, and instructs them to go in the advance direction and shelter from a pithead or the emergency exit at the blocks $\mathbf{5}_{4a}$ to $\mathbf{5}_{8a}$ is performed. On the other hand, at the blocks $\mathbf{5}_{1b}$ to $\mathbf{5}_{8b}$ in the tunnel 10*b*, the loudspeaker broadcasting that instructs the persons to further go in the advance direction and shelter is performed. The loudspeaker broadcasting at this time is alternately performed at the adjacent blocks as described above.

As described above, according to the loudspeaker broadcasting system and loudspeaker broadcasting apparatus in this embodiment, since the bi-directional speaker is provided, and from the loudspeaker broadcasting through the bi-directional speaker 1 the frequency components having a long reverberation time is removed by the equalizer 351, the reverberation is reduced even in the tunnel 10 where the sound is difficult to damp and the reverberation time is long, so that the loudspeaker broadcasting having the high intelligibility in the both directions of the tunnel extending direction can be realized.

Further, the automatic sound volume adjuster 361 adjusts the sound volume of the loudspeaker broadcasting through the bi-directional speaker 1, and the sound volume of the loudspeaker broadcasting is adjusted so as to arrive at the block in the predetermined range where one bi-directional speaker is provided. Therefore, the shelter guide of the appropriate contents according to the condition can be performed at each block in the tunnel 10. Further, as shown in FIG. 3, the loudspeaker broadcasting is performed alternately at the adjacent blocks 5. Therefore, it is possible to prevent interference of the loudspeaker broadcastings at the adjacent blocks and to prevent reduction of sound clearness of the loudspeaker broadcasting. Further, since there is the blank for the predetermined time (sound no-reinforcement time) between the loudspeaker broadcasting times, the persons in the tunnel 10 can listen to the loudspeaker broadcasting without receiving the influence of reverberation.

Though the place at which this system is installed is the tunnel 10 in this embodiment, it may be a space having the much reverberation, for example, an underpass. Further, a microphone may be placed in the tunnel 10 in order to perform self-diagnosis of operation by receiving the loudspeaker broadcasting through the bi-directional speaker 1 in the microphone and checking its level. Further, this self-diagnostic result may be recorded as a log.

Further, though the speaker comprises two speakers having negative-phase outputs and facing in the opposite directions to have bi-directivity in the embodiment, a mono speaker having bi-directivity may be used.

As described above, according to the invention, it is possible to provide a loudspeaker broadcasting system and a loudspeaker broadcasting apparatus which can perform a loudspeaker broadcasting of appropriate contents at each block without reducing sound clearness.

What is claimed is:

1. A loudspeaker broadcasting system which performs loudspeaker broadcasting in a closed space, comprising:

a speaker arranged at each block of said space;

a spot detecting unit detecting a spot in said space;

a control unit that determines, on the basis of the spot detected by said spot detecting unit, contents of loudspeaker broadcasting through said speaker at each block; and a broadcasting control unit which controls loudspeaker broadcasting through said speakers so as to perform the broadcasting only at one of two adjacent blocks at any given time.

2. The loudspeaker broadcasting system according to claim 1, wherein said broadcasting control unit provides a sound no-reinforcement time between a loudspeaker broadcasting time and a next loudspeaker broadcasting time to control loudspeaker broadcasting.

3. The loudspeaker broadcasting system according to claim 1, wherein the control unit is configured to permit the contents of the loudspeaker broadcasting through a first one of the plurality of speakers to be different from the contents of the loudspeaker broadcasting through a second one of the plurality of speakers.

4. The loudspeaker broadcasting system according to claim 1, wherein at least one of said plurality of speakers comprises two speakers having negative-phase outputs and facing in the opposite directions thereby to have bi-directivity.

5. The loudspeaker broadcasting system according to claim 1, wherein an equalizer is provided, which removes frequency components having a long reverberation time when the loudspeaker broadcasting is performed in said space.

6. The loudspeaker broadcasting system according to claim 1, comprising:

a noise condition detecting unit for detecting a noise condition at one block in said space, which is arranged at each block in said space; and a sound volume adjusting unit, according to a detection result of said noise condition detecting unit, adjusts output level of a speaker of said plurality of speakers which is arranged at the same block as the block at which said noise condition detecting unit is arranged.

7. The loudspeaker broadcasting system according to claim 1, wherein said spot detecting unit comprises an accident occurrence detecting sensor that detects occurrence of an accident at one block in said space, outputs an accident occurrence signal including identification data of each sensor, and is arranged at each block in said space; and an accident occurrence block detecting unit detects, upon reception of the accident occurrence signal output from said accident occurrence detecting sensor, which block the accident has occurred at on the basis of the identification data included in said accident occurrence signals.

8. The loudspeaker broadcasting system according to claim 1, further comprising a sound source storing plural kinds of loudspeaker broadcasting contents, wherein said control unit selects the loudspeaker broadcasting contents from said sound source to read out it.

9. The loudspeaker broadcasting system according to claim 1, wherein said space is a tunnel or an underpass.

* * * * *